United States Patent [19]

Minami et al.

[11] 4,213,430

[45] Jul. 22, 1980

[54] SPARK-IGNITION INTERNAL COMBUSTION ENGINE CAPABLE OF REDUCING NOXIOUS CONSTITUENTS IN EXHAUST GASES

[75] Inventors: Hidehiro Minami, Yokohama; Teruo Aoki, Hachiohji, both of Japan

[73] Assignee: Nissan Motor Company, Limited, Yokohama, Japan

[21] Appl. No.: 931,984

[22] Filed: Aug. 8, 1978

Related U.S. Application Data

[63] Continuation of Ser. No. 672,405, Mar. 31, 1976, abandoned.

[30] Foreign Application Priority Data

Apr. 1, 1975 [JP] Japan ..... 50/40143

[51] Int. Cl.[2] ..... F02M 25/06

[52] U.S. Cl. ..... 123/440

[58] Field of Search ..... 123/119 EC, 119 E, 32 EE, 123/32 EA, 119 A, 148 C, 52 M; 60/299

[56] References Cited

U.S. PATENT DOCUMENTS

| | | | |
|---|---|---|---|
| 1,456,144 | 5/1923 | Nyhagen | 123/148 C |
| 2,906,910 | 9/1975 | Szlaga, Jr. | 123/119 R |
| 3,257,631 | 9/1941 | Wahlberg | 123/52 M X |
| 3,762,384 | 10/1973 | Day et al. | 123/119 A |
| 3,809,042 | 5/1974 | Hosho et al. | 123/148 C |
| 3,911,884 | 10/1974 | Moriya et al. | 123/32 EE |
| 3,921,612 | 11/1975 | Aono | 123/119 EC |
| 3,942,493 | 3/1976 | Linder | 123/119 EC |
| 3,953,576 | 4/1976 | Meguerian et al. | 60/299 |

*Primary Examiner*—Wendell E. Burns

[57] ABSTRACT

The emission level of NOx of a spark-ignition internal combustion engine is lowered by recirculating a relatively large amount of exhaust gases into the combustion chambers of the engine, whereas the emission levels of CO and HC are lowered by controlling the air-fuel ratio of the air-fuel mixture supplied into the combustion chambers at a desired value utilizing feedback techniques in accordance with the composition of the exhaust gases discharged from the combustion chambers.

18 Claims, 3 Drawing Figures

CONTROL CIRCUIT

SPARK-IGNITION INTERNAL COMBUSTION ENGINE CAPABLE OF REDUCING NOXIOUS CONSTITUENTS IN EXHAUST GASES

This is a continuation of application Ser. No. 672,405, filed Mar. 31, 1976 now abandoned.

This invention relates to spark-ignition internal combustion engines capable of effectively reducing the emission levels of noxious constituents of exhaust gases such as nitrogen oxides, carbon monoxide and hydrocarbons.

As is well known, gasoline or petrol powered spark-ignition internal combustion engines discharge the exhaust gases containing noxious constituents such as nitrogen oxides, carbon monoxide and hydrocarbons. Of these noxious constituents, carbon monoxide and hydrocarbons are the lowest in the emission level when the engine is operated on an air-fuel mixture having about stoichiometric air-fuel ratio. On the contrary, the emission level of nitrogen oxides is the highest when operated on the about stoichiometric air-fuel mixture. Accordingly, difficulties have been encountered in which the emission level of nitrogen oxides is increased as the emission levels of carbon monoxide and hydrocarbons are decreased by operating the engine on an air-fuel mixture having a desired air-fuel ratio.

It is, therefore, a principal object of the present invention to provide an improved spark-ignition internal combustion engine capable of effectively reducing the emission levels of noxious constituents including nitrogen oxides, carbon monoxide and hydrocarbons.

Another object of the present invention is to provide an improvide spark-ignition internal combustion engine in which the emission level of nitrogen oxides is lowered by recirculating a relatively large amount of exhaust gases into the combustion chambers, and the emission levels of carbon monoxide and hydrocarbons are lowered by supplying the combustion chambers with about stoichiometric air-fuel mixture.

A further object of the present invention is to provide an air-fuel ratio control means for accurately controlling the air-fuel ratio of the air-fuel mixture supplied into the combustion chambers of a spark-ignition internal combustion engine into a desired value utilizing feedback techniques in accordance with the composition of the exhaust gases discharged from the combustion chambers.

Other objects and features of the improved spark-ignition internal combustion engine in accordance with the present invention will become more apparent from the following description with reference to the accompanying drawing in which.

Figures 1, 2, 3:
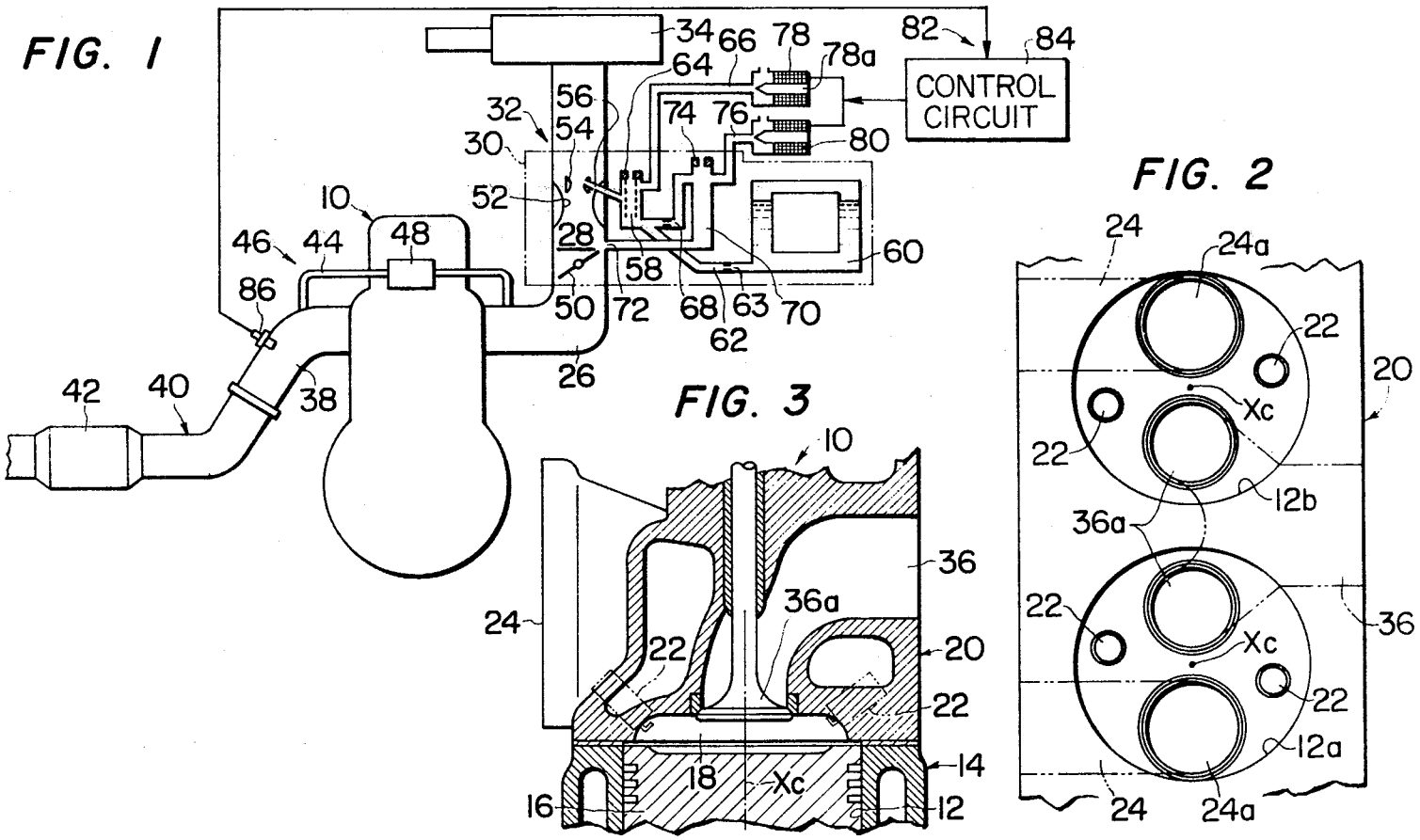
FIG. 1 is a schematical illustration of a spark-ignition internal combustion engine in accordance with the present invention.
FIG. 2 is a schematic plan view showing a combustion chamber of the engine of FIG. 1.
FIG. 3 is a cross-sectional view of the cylinder head of the engine of FIG. 1.

Referring now to the drawing, there is shown a preferred embodiment of a spark-ignition internal combustion engine in accordance with the present invention, in which the engine is generally designated by the reference numeral 10. The engine 10 has a cylinder or cylinders 12, as usual, formed in the cylinder block 14 thereof. A piston or pistons 16 are, as customary, reciprocally disposed within the cylinders 12. A combustion chamber or combustion chambers 18 are defined by the crowns of the pistons 16 and the cylinder head 20 which is secured to the upper portion of the cylinder block 14. As viewed in FIG. 2, two spark plugs 22 are disposed through the cylinder head 20 and projected into each of the combustion chambers 18 in such a manner as to be opposite to each other with respect to the center axis Xc of the cylinder 12 with a relatively large space therebetween. The number of the spark plugs 22 disposed in a combustion chamber 18 may be more than two.

Each of the combustion chambers 18 is communicable through an intake port 24 and an intake valve **24*a* with an intake passage 26 which is connected to the air-fuel mixture induction passage 28 of a carburetor 30 or air-fuel mixture supply means in an intake system 32. The carburetor 30 is as usual communicated with an air filter 34. The combustion chamber 18 is communicable through an exhaust port 36 and an exhaust valve 36*a* with an exhaust passage 38 of an exhaust system 40. The exhaust passage 38 is, as customary, connected to a catalytic converter 42 or an exhaust gas purifying device for purifying exhaust gases discharged from the combustion chambers 18. As seen in FIG. 2, the two exhaust ports of neighboring each two cylinders 12*a* and 12*b* are joined and siamesed in the cylinder head 20 to form a siamesed port 36. Additionally, the cylinder head 20 is formed into a cross-flow induction-exhaust arrangement in which the intake ports 24 are formed on one side of the cylinder head 20 to be communicated with the intake passage 26, whereas the exhaust ports 36 are formed on the opposite side of the cylinder head 20 to be communicated with the exhaust passage 38**.

A conduit 44 forming part of exhaust gas recirculating means 46 connects between the exhaust passage 38 to the intake passage 26 for recirculating a portion of the exhaust gases with the air-fuel mixture passing through the intake passage 26 into the combustion chambers 18. Disposed intermediate of the conduit 44 is an exhaust gas recirculation control valve 48 which is arranged to control the flow amount of the exhaust gases into the intake passage 26, for example, in accordance with the venturi vacuum produced in the venturi portion of the carburetor 30, the venturi vacuum being a function of the amount of the inducted air or intake air supplied into the combustion chambers 18 through the intake passage 26. The control valve 48 is preferably constructed and set to control the rate of the amount of the exhaust gases recirculated into the combustion chambers 18 in the range of from 10 to 50% to the amount of the inducted air.

It is to be noted that a high spark energy generated by the two spark plugs 22 can reliably ignite and burn even the compressed air-fuel mixture containing such a high rate of exhaust gases in the combustion chamber 18. Additionally, the burning of the compressed air-fuel mixture is carried out so that two flame flonts are produced adjacent the inner wall surface of the combustion chamber 18, a so-called quench area, and thereafter these flame flonts move toward the center of the combustion chamber heating it to a high temperature. Accordingly, the distance of flame propagation is shortened as compared with a conventional engine using only one spark plug in a combustion chamber. Thus, combustion of the air-fuel mixture is faster propagated and completed at the central portion of the combustion chamber 18, at a high temperature, thereby achieving stable and smooth combustion of the air-fuel mixture. This results in stable operation of the engine even when considerable amounts of exhaust gases are presented in the combustion chamber 18.

The carburetor 30 has a throttle valve 50 rotatably disposed within the air-fuel mixture induction passage 28 thereof. A main venturi portion 52 is located upstream of the throttle valve 50, and a secondary venturi portion 54 is located adjacent the main venturi portion 52. Opened to the secondary venturi portion 54 is a main discharge nozzle 56 of a main circuit which nozzle is communicated with a main well 58 which is in turn communicated with a float bowl 60 through a main fuel passage 62 having therein a main jet 63. The main well 58 has a main air bleed 64 and a first auxiliary air bleed 66. The main well 58 is further communicated through a restrictor 68 with a fuel passage 70 of a low-speed circuit which passage is communicated with a slow port 72 opened to the air-fuel mixture induction passage 28 downstream of the main venturi portion 52. The fuel passage 70 has a low-speed circuit air bleed 74 and a second auxiliary air bleed 76.

A first solenoid valve 78 or first air flow amount control means is disposed for opening or closing the first auxiliary air bleed 66 and arranged to take a first state wherein the actuating rod **78*a* thereof is moved with respect to the first auxiliary air bleed 66 to increase the flow amount of air inducted through the first auxiliary air bleed 66 into the main well 58 than a predetermined level, whereas take a second state wherein the actuating rod or member 78*a* thereof is moved with respect to the first auxiliary air bleed 66 to decrease the flow amount of the air inducted through the auxiliary air bleed 66 into the main well 58 than the predetermined level. A second solenoid valve 80 or second air flow control means is electrically connected in parallel with the first solenoid valve 78 and arranged to be operated similarly to the first solenoid valve 78. The first and second solenoid valves 78 and 80 form part of air-fuel ratio control means 82 and electrically connected to a control circuit 84**.

The control circuit 84 is arranged to generate a first command signal for placing the first and second solenoid valves 78 and 80 into the first state and a second command signal for placing the first and second solenoid valves 78 and 80 into the second state. The control circuit 84 is electrically connected to an exhaust gas sensor 86 which is disposed within the exhaust passage 38 of the exhaust system 40 upstream of the catalytic converter 42. The exhaust gas sensor 86 is arranged to generate a first information signal (which may be a voltage signal) for causing the control circuit 84 to generate the first command signal when the exhaust gases passing through the exhaust passage 38 have a first composition representing that the combustion chambers 18 are fed with an air-fuel mixture richer than a predetermined level such as stoichiometric air-fuel ratio (14.8:1), and a second information signal for causing the control circuit 84 to generate the second command signal when the exhaust gases passing through the exhaust passage 38 have a second composition representing that the combustion chambers 18 are fed with an air-fuel mixture leaner than the predetermined level. The exhaust gas sensor 86 may be an oxygen ($O_2$) sensor, a nitrogen oxides (NOx) sensor, a carbon monoxide (CO) sensor, a carbon dioxides ($CO_2$) sensor or a hydrocarbon (HC) sensor which are respectively detect the concentration of $O_2$, NOx, CO, $CO_2$ or HC contained in the exhaust gases discharged from the combustion chambers 18. The catalytic converter 42 may be an oxidation catalytic converter, a reduction catalytic converter, or a three-way catalytic converter capable of reducing NOx as well as oxidizing CO and HC, or may be replaced with a thermal reactor. In order to operate the first and second air flow amount control means 78 and 80 in the above discussed manner, the control circuit 84 may be arranged to set, as a reference voltage, a specified voltage signal generated by the exhaust gas sensor 86 when the predetermined level of the air-fuel mixture is supplied into the combustion chambers, and to generate the first command signal when the level of the voltage signal from the sensor 86 is lower than that of the specified voltage signal representing that the combustion chambers are fed with the air-fuel mixture leaner than the predetermined level and the second command signal when the level of the voltage signal from the sensor 86 is higher than that of the specified voltage signal representing that the combustion chambers are fed with the air-fuel mixture richer than the predetermined level.

With the arrangement hereinbefore discussed, during the operation of the engine 10, a relatively large amount of the exhaust gases is introduced from the exhaust passage 38 through the conduit 44 of the exhaust gas recirculating means 46 into the intake passage 26 and thereafter inducted, with the air-fuel mixture prepared by the carburetor 30, into the combustion chambers 18. The air-fuel mixture containing the exhaust gases is ignited and effectively burned by the two spark plugs 22 disposed within each the combustion chamber 18. Due to the effect of the recirculated exhaust gases, the maximum temperature within the combustion chambers 18 is lowered and accordingly the emission level of NOx is reduced as compared with the engine without the exhaust gas recirculating means.

When the combustion chambers 18 are fed with the air-fuel mixture richer than the predetermined level such as stoichiometric air-fuel ratio, the first and second solenoid valves 78 and 80 are operated to increase the flow amounts of air inducted respectively through the first and second auxiliary air bleeds 66 and 76 into the main well 58 and the fuel passage 70 of the low-speed circuit. Then, the flow amounts of fuel through the main nozzle 56 and the slow port 72 are decreased and accordingly the air-fuel mixture fed into the combustion chambers 18 are made leaner. On the contrary, when the combustion chambers 18 are fed with the air-fuel mixture leaner than the predetermined level, the first and second solenoid valves 78 and 80 are operated to decrease the flow amount of air inducted respectively through the first and second auxiliary air bleeds 66 and 76 into the main well 58 and the fuel passage 70 of the low-speed circuit. Then, the flow amounts of fuel through the main nozzle 56 and the slow port 72 are increased and accordingly, the air-fuel mixture fed into the combustion chambers 18 are enriched. As discussed above, the air-fuel mixture supplied into the combustion chambers 18 can be always maintained accurately at the predetermined level such as the stoichiometric air-fuel ratio.

While only the solenoid valves 78 and 80 of the type wherein the air flow amounts into the main well 58 and the fuel passage 70 are controlled in on and off manner are shown and described, it will be understood that means for controlling the air flow amount in a continuous manner may be used in place of the solenoid valves 78 and 80.

The present invention provides a variety of advantages which may be stated as follows:

1. Since relatively large amounts of the exhaust gases are recirculated in the combustion chambers, the emission level of NOx is greatly lowered and tendency liable to occur knocking of the engine is decreased. Accordingly, increase of the compression ratio of the engine and raising the upper limit of the engine coolant temperature can be possible causing increase of engine output power and improvement in fuel consumption.

2. The emission level of HC is lowered considerably since complete combustion within the combustion chambers is promoted due to the fact that the combustion is initiated adjacent to the inner wall surface of each combustion chamber or the so-called quench area.

3. The air-fuel ratio of the air-fuel mixture supplied into the combustion chambers is always accurately maintained at stoichiometric one end therefore variations in the emission levels of NOx, CO and HC are minimized providing more accurate and improved control of noxious constituents in the exhaust gases.

4. The improvement in engine output power and exhaust gas control is accomplished by increasing the volumetric efficiency and the scavenging efficiency of the engine since the engine employs a cross-flow induction-exhaust cylinder head.

5. If the engine is equipped with an afterburner such as a thermal reactor for reburning the unburned constituents in the exhaust gases discharged from the combustion chambers, the afterburner is maintained at a high temperature sufficient to accomplish therewithin oxidation reaction of the unburned constituents in the exhaust gases since the engine employs siamesed ports wherein two exhaust ports of neighboring two combustion chambers are siamesed within the cylinder head of the engine.

It will now be appreciated from the foregoing description that, according to the present invention, the emission level of NOx is lowered by recirculating a relatively large amount of the exhaust gases into the combustion chambers, and the emission levels of CO and HC are lowered by supplying the combustion chambers with the air-fuel mixture having stoichiometric air fuel ratio at which the minimum emission levels of CO and HC is obtained. In addition, the exhaust gases discharged from the combustion chambers supplied with the stoichiometric air-fuel mixture allows to effectively accomplish the purification of the noxious constituents of the exhaust gases within the exhaust gas purifying device particularly the three-way catalytic converter.

What is claimed is:

1. A spark-ignition internal combustion engine having a cylinder in which a combustion chamber is defined by a cylinder head and a piston crown, comprising:

air-fuel mixture supply means for supplying an air-fuel mixture induced into the combustion chamber, said air-fuel mixture supply means being communicated through an intake passage with the combustion chamber and having a throttle valve;

exhaust gas recirculating means for recirculating a portion of exhaust gases with the induced air-fuel mixture into the combustion chamber, said exhaust gas recirculating means including conduit means which connects an exhaust passage of the engine with the intake passage downstream of the throttle valve a plurality of spark plugs disposed within the combustion chamber for reliably igniting the air-fuel mixture containing the recirculated exhaust gases;

a three-way catalytic converter communicable through the exhaust passage with the combustion chamber to purify the noxious constituents in the exhaust gases discharged from the combustion chamber, said three-way catalytic converter being designed to reduce nitrogen oxides and oxidize carbon monoxide and hydrocarbons in the exhaust gases; and air-fuel ratio control means for controlling air-fuel ratio of the air-fuel mixture supplied into the combustion chamber at stoichiometric value so as to accomplish effective purification of noxious constituents in said three-way catalytic converter, whereby the emission levels of nitrogen oxides, carbon monoxide and hydrocarbons in the exhaust gases are considerably decreased improving fuel consumption.

2. A spark-ignition internal combustion engine as claimed in claim 1, in which said air-fuel mixture supply means includes a carburetor having a main discharge nozzle opened into the venturi portion of the carburetor, a main well communicated through a main fuel passage with the main discharge nozzle and communicated with the float bowl of the carburetor, a main air bleed communicated with the main well for introducing therethrough the atmospheric air into the main well, and a first auxiliary air bleed communicated with the main well for introducing therethrough the atmospheric air into the main well.

3. A spark-ignition internal combustion engine as claimed in claim 2, in which said air-fuel ratio control means includes:

first air flow amount control means for controlling flow amount of air inducted through the first auxiliary air bleed into the main well, said first air flow amount control means being operated electrically and arranged to take a first state wherein the flow amount of the air is increased than a predetermined level and a second state wherein the flow amount of the air is decreased than the predetermined level;

control circuit electrically connected to said air flow amount control means and arranged to generate a first command signal to place said air flow amount control means into the first state and a second command signal to place said air flow amount control means into the second state;

an exhaust gas sensor disposed within the exhaust gas passage of the exhaust system communicated with downstream of the combustion chamber of the engine and electrically connected to said control circuit, said exhaust gas sensor being arranged to generate a first information signal for causing said control circuit to generate the first command signal when the exhaust gases passing through the exhaust passage have a first composition representing that the combustion chamber is fed with an air-fuel mixture richer than a predetermined level, and a second information signal for causing said control circuit to generate the second command signal when the exhaust gases passing through the exhaust passage have a second composition representing that the combustion chamber is fed with an air-fuel mixture leaner than the predetermined level.

4. A spark-ignition internal combustion engine as claimed in claim 3, in which said air flow amount control means includes a first solenoid valve having an actuating member which is arranged to be moved with respect to the first auxiliary air bleed to increase the flow amount of air inducted through the first auxiliary air bleed into the main well than the predetermined level upon receiving the first command signal from the control circuit, and moved with respect to the first auxiliary air bleed to decrease the flow amount of the same air than the predetermined level upon receiving the second command signal from said control circuit.

5. A spark-ignition internal combustion engine as claimed in claim 4, in which said exhaust gas recirculating means includes a conduit means connected between the exhaust passage communicated downstream of the combustion chamber and the intake passage communicated upstream of the combustion chamber, and control valve means for controlling the flow amount of the recirculated exhaust gases at a predetermined rate with respect to the flow amount of the air inducted into the combustion chamber.

6. A spark-ignition internal combustion engine as claimed in claim 5, in which said predetermined rate is in the range of from 10 to 50% by volume of the air inducted into the combustion chamber.

7. A spark-ignition internal combustion engine as claimed in claim 6, in which said plurality of the spark plugs are two spark plugs.

8. A spark-ignition internal combustion engine as claimed in claim 7, in which said two spark plugs are disposed through the cylinder head of the engine to project into the combustion chamber, said two spark plug being located opposite to each other with respect to the center axis of the cylinder.

9. A spark-ignition internal combustion engine as claimed in claim 3, in which said carburetor further includes a fuel passage for the low-speed circuit of the carburetor, said fuel passage communicating the main fuel passage through a restrictor with a slow port opened to the air-fuel mixture induction passage downstream of the venturi portion of the carburetor, a low-speed circuit air bleed communicated with the fuel passage, and a second auxiliary air bleed communicated with the fuel passage for introducing therethrough the atmospheric air into the fuel passage.

10. A spark-ignition internal combustion engine as claimed in claim 9, in which said air-fuel ratio control means further includes second air flow amount control means for controlling the flow amount of air inducted through the second auxiliary air bleed into the fuel passage of the low-speed circuit, said second air flow amount control means being operated electrically and electrically connected in parallel with the first air flow amount control means, and arranged to take a first state wherein the flow amount of air is increased than a predetermined level and a second state wherein the flow amount of the same air is decreased than the predetermined level, said second air flow control means being placed into the first state upon receiving first command signal from said control circuit and into the second state upon receiving the second command signal from said control circuit.

11. A spark-ignition internal combustion engine as claimed in claim 10, in which said second flow amount control means includes a second solenoid valve having an actuating member which is arranged to be moved with respect to the second auxiliary air bleed to increase the flow amount of air inducted through the second auxiliary air bleed into the fuel passage of the low-speed circuit than the predetermined level upon receiving the first command signal from said control circuit, and moved with respect to the second auxiliary air bleed to decrease the flow amount of the same air than the predetermined level upon receiving the second command signal from said control circuit.

12. A spark-ignition internal combustion engine as claimed in claim 1, further comprising an exhaust gas purifying device communicable with the combustion chamber for oxidizing unburned constituents in the exhaust gases discharged from the combustion chamber.

13. A spark-ignition internal combustion engine as claimed in claim 12, said exhaust gas purifying device includes an oxidation catalytic converter communicable with the combustion chamber for oxidizing carbon monoxide and hydrocarbon in the exhaust gases discharged from the combustion chamber.

14. A spark-ignition internal combustion engine as claimed in claim 12, said exhaust gas purifying device includes reduction catalytic converter communicable with the combustion chamber for reducing nitrogen oxide in the exhaust gases discharged from the combustion chamber.

15. A spark-ignition internal combustion engine as claimed in claim 3, in which said exhaust gas sensor is an oxygen sensor for detecting the concentration of oxygen contained in the exhaust gases discharged from the combustion chambers.

16. A spark-ignition internal combustion engine as claimed in claim 1, in which the engine has at least two combustion chambers, the exhaust ports of the two combustion chambers being a siamesed within the cylinder head to form a siamesed exhaust port.

17. A spark-ignition internal combustion engine as claimed in claim 1, in which said exhaust passage provides communication between the combustion chamber and the atmosphere to discharge the exhaust gases to the atmosphere.

18. A spark-ignition internal combustion engine having a cylinder in which a combustion chamber is defined by a cylinder head and a piston crown, comprising:

a carburetor communicable through an intake passage with the combustion chamber, said carburetor including a throttle valve, a main discharge nozzle opened into the venturi portion of the carburetor, a main well communicated through a main fuel passage with the main discharge nozzle and communicated with the float bowl of the carburetor, a main air bleed communicated with the main well for introducing therethrough the atmospheric air into the main well, and a first auxiliary air bleed communicated with the main well for introducing therethrough the atmospheric air into the main well;

exhaust gas recirculating means for recirculating a portion of exhaust gases with the induced air-fuel mixture into the combustion chamber, said exhaust gas recirculating means including an exhaust gas recirculation conduit which connects an exhaust passage with the intake passage downstream of the throttle valve of said carburetor;

two spark plugs disposed in the combustion chamber to reliably ignite the air-fuel mixture containing the air-fuel mixture mixed with the recirculated exhaust gases;

a three-way catalytic converter communicable through the exhaust passage with the combustion chamber to purify the noxious constitutents in the exhaust gases discharged from the combustion chamber, said three-way catalytic converter being designed to reduce nitrogen oxides and oxidize carbon monoxide and hydrocarbons in the exhaust gases; and air-fuel ratio control means for controlling the air-fuel ratio of the air-fuel mixture supplied to the combustion chamber at stoichiometric value so as to accomplish effective purification of the noxious constituents in said three-way catalytic converter, said air-fuel ratio control means includes first air flow amount control means for controlling flow amount of the air induced through the first auxiliary air bleed into the main well, said first air flow amount control means being operated electrically and arranged to take a first state wherein the flow amount of the air is increased above a predetermined level and a second state wherein the flow amount of the air is decreased below the predetermined level, control circuit electrically connected to said air flow amount control means and arranged to generate a first command signal to place said air flow amount control means into the first state and a second command signal to place said air flow amount control means into the second state, and an exhaust gas sensor disposed within the exhaust gas passage of the exhaust system communicated with downstream of the combustion chamber of the engine and electrically connected to said control circuit, said exhaust gas sensor being arranged to generate a first information signal for causing said control circuit to generate the first command signal when the exhaust gases passing through the exhaust passage have a first composition representing that the combustion chamber is fed with an air-fuel mixture richer than stocihiometric value, and a second information signal for causing said control circuit to generate the second command signal when the exhaust gases passing through the exhaust passage have a second composition representing that the combustion chamber is fed with an air-fuel mixture leaner than stoichiometric value.

* * * * *